US006616900B1

(12) United States Patent
Lomas

(10) Patent No.: US 6,616,900 B1
(45) Date of Patent: Sep. 9, 2003

(54) FCC PROCESS WITH TWO ZONE SHORT CONTACT TIME REACTION CONDUIT

(75) Inventor: David A. Lomas, Barrington, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/418,782

(22) Filed: Oct. 15, 1999

Related U.S. Application Data

(62) Division of application No. 08/985,990, filed on Dec. 5, 1997, now Pat. No. 6,010,618.

(51) Int. Cl.[7] ..... C10G 11/00; B01J 8/18

(52) U.S. Cl. ..... 422/147; 422/139; 422/141; 422/142; 422/144; 422/145; 208/113; 208/140; 208/151

(58) Field of Search ..... 208/153, 113, 208/120, 140, 164, 151; 422/139, 140, 141, 142, 144, 145, 147

(56) References Cited

U.S. PATENT DOCUMENTS

| | | | | | |
|---|---|---|---|---|---|
| 4,070,159 | A | * | 1/1978 | Myers et al. | 208/161 |
| 4,397,738 | A | | 8/1983 | Kemp | 208/161 |
| 4,859,313 | A | | 8/1989 | Lengemann et al. | 208/113 |
| 4,960,503 | A | | 10/1990 | Haun et al. | 208/85 |
| 4,985,136 | A | | 1/1991 | Bartholic | 208/153 |
| 5,017,343 | A | | 5/1991 | Cetinkaya | 422/140 |
| 5,296,131 | A | | 3/1994 | Raterman | 208/113 |
| 5,324,419 | A | | 6/1994 | Muldowney | 208/120 |
| 5,332,704 | A | | 7/1994 | Bartholic | 502/41 |
| 5,451,313 | A | | 9/1995 | Wegerer et al. | 208/164 |
| 5,506,365 | A | * | 4/1996 | Mauleon et al. | 208/113 |
| 5,554,341 | A | * | 9/1996 | Wells et al. | 208/108 |
| 5,565,020 | A | | 10/1996 | Niewiedzial | 95/271 |
| 5,584,986 | A | | 12/1996 | Bartholic | 208/151 |
| 5,858,207 | A | | 1/1999 | Lomas | 208/113 |
| 5,958,222 | A | * | 9/1999 | Radcliffe et al. | 208/163 |

* cited by examiner

*Primary Examiner*—Jerry D. Johnson
*Assistant Examiner*—Alexa A. Doroshenk
(74) *Attorney, Agent, or Firm*—John G. Tolomei; James C. Faschall

(57) ABSTRACT

An FCC process provides ultrashort catalyst and feed contacting in an FCC riser by recovering a short contact product stream in an intermediate section of the riser. The remainder of the catalyst and gas mixture continues through the riser along a continuous flow path for further controlled cracking of the heavier adsorbed hydrocarbons and entrained hydrocarbons. Residual catalyst separated from the recovery of the short contact product stream returns to the upstream end of the riser for recycle. The section of the riser downstream of the short contact product recovery may receive additional feed to perform secondary cracking reactions. The riser arrangement greatly simplifies methods for performing ultrashort FCC feed and catalyst contacting.

8 Claims, 1 Drawing Sheet

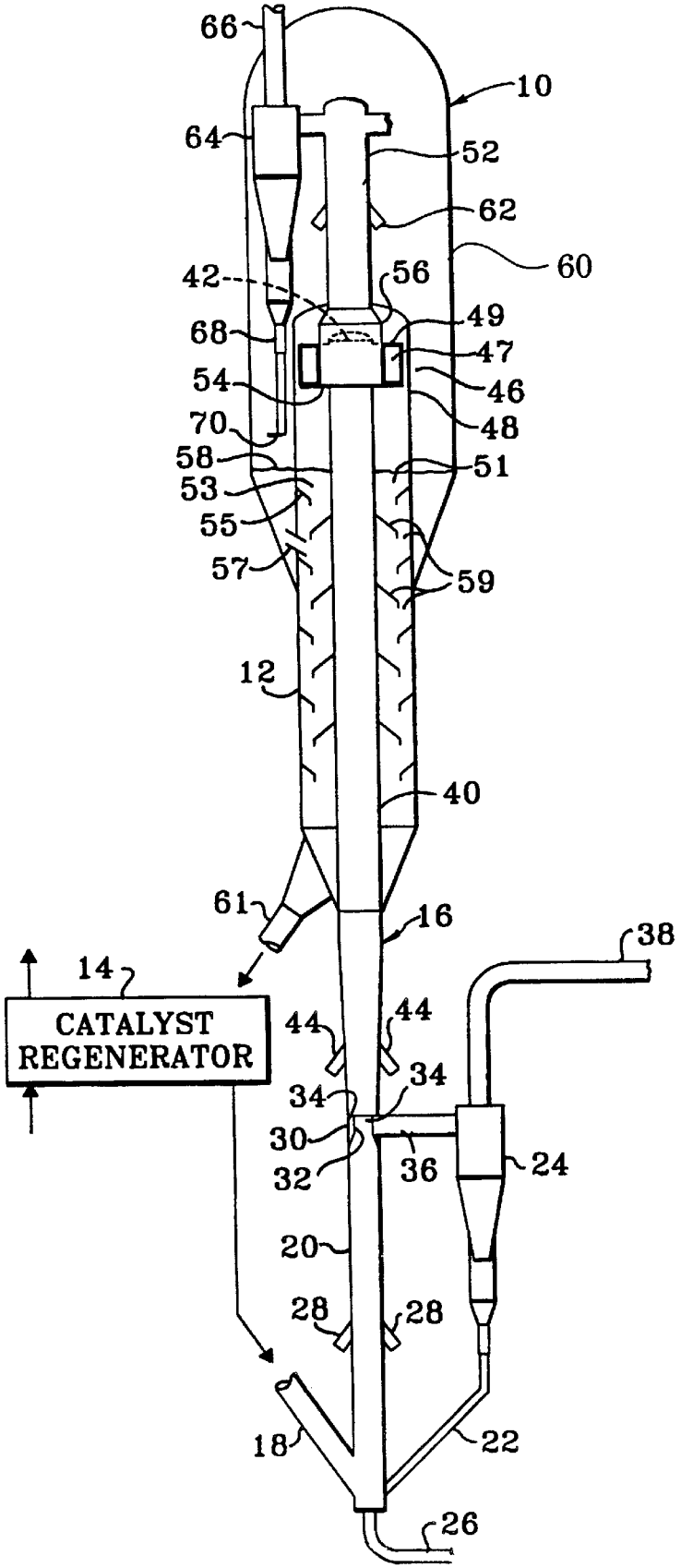
66
10
64
52
62
60
42
56
49
68
47
54
46
70
48
58
51
53
55
57
59
12
40
61
16
38
14
CATALYST
REGENERATOR
44
44
34
34
30
32
36
24
20
28
28
18
22
26

FCC PROCESS WITH TWO ZONE SHORT CONTACT TIME REACTION CONDUIT

CROSS-REFERENCE TO RELATED APPLICATION

This application is a divisional application of Ser. No. 08/985,990 filed Dec. 5, 1997, now U.S. Pat. No. 6,010,618, the contents of which are hereby incorporated by reference.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to cracking of FCC feedstreams in a transport contacting conduit.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to generally by those skilled in the art as "spent catalyst", is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

Despite the long existence of the FCC process, techniques are continually sought for improving product recovery both in terms of product quantity and composition, i.e. yield and selectivity. One facet of the FCC process that receives continued attention is the initial contacting of the FCC feed with the regenerated catalyst. Improvement in the initial feed and catalyst contacting tends to benefit yield and selectivity.

A variety of devices and piping arrangements have been employed to initially contact catalyst with feed. Most recent FCC arrangements contact catalyst in a riser conduit that transports the feed and catalyst upwardly in dilute phase as the reaction occurs. U.S. Pat. No. 5,017,343 is representative of devices that attempt to improve feed and catalyst contacting by maximizing feed dispersion. Another approach to improved feed and catalyst contacting is to increase the penetration of the feed into a flowing stream of catalyst. U.S. Pat. No. 4,960,503 exemplifies this approach where a plurality of nozzles surround an FCC riser to shoot feed into a moving catalyst stream from a multiplicity of discharge points. While these methods do improve distribution of the feed into the hot regenerated catalyst stream, there is still a transitory period of poor distribution when the relatively small quantities of the hydrocarbon feed disproportionately contact large quantities of hot catalyst. This poor thermal distribution results in non-selective cracking and the production of low value products such as dry gas.

The processing of increasingly heavier feeds and the tendency of such feeds to elevate coke production and yield undesirable products has led to new methods of contacting FCC feeds with catalyst. Of particular interest recently have been methods of contacting FCC catalyst for very short contact periods. U.S. Pat. No. 4,985,136 discloses an ultrashort contact time process for fluidized catalytic cracking, the contents of which are hereby incorporated by reference, that contacts an FCC feed with a falling curtain of catalyst for a contact time of less than 1 second and follows the contacting with a quick separation. U.S. Pat. No. 5,296,131, the contents of which are hereby incorporated by reference, discloses a similar ultrashort contact time process that uses an alternate falling catalyst curtain and separation arrangement. The ultrashort contact time system improves selectivity to gasoline while decreasing coke and dry gas production by using high activity catalyst that contacts the feed for a relatively short period of time. The inventions that provide short contact time are specifically directed to zeolite catalysts having high activity. The short contact time arrangements permit the use of much higher zeolite content catalysts that increase the usual 25–30% zeolite contents of the FCC catalyst to amounts as high as 40–60% zeolite in the cracking catalyst. These references teach that shorter hydrocarbon and catalyst contact time is compensated for by higher catalyst activity. Methods for ultrashort catalyst and feed contacting require unconventional contacting equipment and extensive replacement of existing equipment.

Many methods of ultrashort catalyst contacting perform an initial fast separation of the primary reacted products and collect the catalyst in a dense bed. The catalyst that enters the dense bed still contains a large amount of adsorbed and entrained hydrocarbons. The continued contacting of these hydrocarbons in a dense phase catalyst bed leads to overcracking of the remaining hydrocarbons and results in loss of products and the production of unwanted light gases.

The mixing of additional spent catalyst with the carbonized catalyst or the addition of catalyst to a traditional FCC riser arrangement or non-traditional short contact time arrangements have also been advantageously employed. U.S. Pat. No. 5,451,313 issued to Wegerer is an arrangement wherein regenerated and spent catalyst are mixed in a distinct chamber at the bottom of the riser and a secondary product stream is withdrawn from the riser. U.S. Pat. No. 5,858,207 issued to Lomas teaches the mixing of spent and regenerated catalyst at the bottom of the riser. The mixing of the regenerated and spent catalyst offers advantages of varying catalyst-to-oil ratios without the increase in catalyst temperature that occurs by the use of regenerated catalyst alone. In this regard, spent catalyst has been found to have sufficient activity to be particularly useful in providing a blended. catalyst mixture.

Therefore, improved or alternate methods are sought for ultrashort catalyst contacting. Improved methods will contact the feed using more conventional type equipment and with more traditional operations. Other improvements will focus on the better control of entrained and adsorbed hydrocarbons that are left on the catalyst.

It is an object of this invention to improve the control of cracking reaction time for light readily cracked hydrocarbons and more refractory heavy hydrocarbons that are adsorbed or otherwise entrained with catalyst.

Another object of this invention is to provide initial ultrashort contacting of the feedstream in a transport conduit with continued controlled residence time cracking of adsorbed or entrained hydrocarbons that remain entrained with the catalyst after withdrawal of the initial product.

A further object of this arrangement is to provide a short contact time system that can be readily operated to provide more traditional contact times.

SUMMARY OF THE INVENTION

This invention is an FCC process arrangement that uses a conventional FCC transport contacting conduit to contact feeds for reduced periods of time before initial withdrawal of a product followed by continued cracking of additional hydrocarbons within the transport contacting conduit. This arrangement can reduce the contacting time for initial contact between an FCC feedstream and catalyst in a transport conduit type reaction zone to times similar to those of other ultrashort feed and contacting arrangements. By recovering an initial product stream from an intermediate section of the transport conduit, rapidly cracked products are quickly recovered without stopping the continued flow of remaining reactants and products through the contacting conduit. The remaining hydrocarbons that are entrained or adsorbed onto the catalyst that passes the first product withdrawal section undergo further cracking through the conduit which can be controlled by varying the length or velocity through the remainder of the conduit.

The arrangement is susceptible to a large number of variations. The separation section in the intermediate section of the riser can be any type of separation that will perform an at least partial separation of gas phase materials from the catalyst without stopping or extensively disrupting the continued flow of catalyst and hydrocarbons through the conduit. Whatever separation devices are provided, it need not provide a complete separation of catalyst from gases, but will preferably provide enough separation to create an initial product stream that is primarily gas phase. Additional catalyst may be recovered from the intermediate product stream through any form of additional separator. Catalyst recovered from the gas stream may be returned to the process for stripping, regeneration, or preferably for recycle to the upstream end of the contacting conduit.

The arrangement of this invention may also have more than one intermediate withdrawal point. Additional withdrawal points may be spaced up the riser to obtain a variety of rough product fractions.

The section of the contacting conduit downstream of the intermediate product withdrawal point or any additional withdrawal point can be operated as a separate reaction section. To this end, additional feeds may be added downstream of any intermediate product stream withdrawal point. Preferred feeds for secondary products will comprise light cycle oil, heavy cycle oil, heavy oil, and heavy naphtha.

In order to maximize residence time control at the end of the transport conduit, it will preferably use a highly contained separation system that again provides a rapid separation from catalyst and gases to rigorously control residence time downstream of the initial product withdrawal. A large number of highly contained separation systems are known for use at the end of riser conduits such as direct connected cyclones and low volume containment vessels that surround the end of the riser, and containment devices that tangentially discharge the catalyst from the end of the riser.

The invention can also use any arrangement of transport conduit for the contacting of the catalyst and feed. Traditional FCC arrangements have used an upward transport riser where catalyst and gases are transported upwardly through the riser and withdrawn from the upper end of the riser. Downflow transport conduits, wherein catalyst is charged to an upstream end of the conduit, have been increasingly proposed. In such arrangements, the contacting takes place as gas transports the catalyst downwardly through the conduit with the added assistance of gravity. This invention may be advantageously employed to a transport conduit having a variety of shapes and directional orientations. However, it is most advantageously employed to either an upflow riser or a downflow conduit.

Accordingly, in a broad embodiment, this invention is a process for the fluidized catalytic cracking of a hydrocarbon stream. The process passes a first stream of catalyst particles comprising regenerated catalyst to a transport contacting conduit. A fresh feedstream contacts catalyst particles in the conduit which transports a mixture of the feedstream and the catalyst therethrough. The mixture of catalyst and feed passes through a first stage of separation located in an intermediate section of the conduit while maintaining continuous fluid flow of at least a portion of the mixture through the intermediate section of the conduit while withdrawing a separated portion of the mixture from the intermediate section of the conduit. Separation produces a lower catalyst density in the portion of the mixture withdrawn from the intermediate section. The remainder of the mixture continues downstream through the conduit to at least one second stage of separation for withdrawing a second mixture from the conduit that at least contains gas phase components. At least a portion of the spent catalyst withdrawn downstream of the first stage of separation passes to a regenerator section that regenerates the spent catalyst to provide the regenerated catalyst.

In a more limited process embodiment, this invention is a process for the fluidized catalytic cracking of a hydrocarbon-containing stream. The process blends a mixture of carbonized and regenerated catalyst at the bottom of the riser conduit to produce a blended catalyst mixture. The blended catalyst mixture contacts a feedstream in the conduit and passes up a first section of the riser to a ballistic separation device that separates a substantially gas phase stream from the feedstream and catalyst mixture. The substantially gas phase stream passes to a separator to recover a product stream and carbonized catalyst. At least a portion of the carbonized catalyst flows back to the bottom of the riser for blending with regenerated catalyst. The remainder of the feedstream and catalyst mixture continues downstream through a second section of the riser and at least partially continuous flow path. The remainder of the feedstream and catalyst mixture is withdrawn from a downstream end of the riser and is separated into a second product stream and a spent catalyst stream. The spent catalyst stream passes to a regenerator to provide the regenerated catalyst.

In an apparatus embodiment, this invention is an apparatus for the fluidized catalytic cracking of hydrocarbons. The apparatus has a transport conduit. The transport conduit is divided into at least three sections. The first section defines a catalyst inlet in communication with a source of regenerated catalyst near its upstream end. Means are provided for injecting a feedstream into the first riser section downstream of the catalyst inlet. A second section is in the path of direct gas and catalyst flow from the first section and defines a short contact product outlet. A third section of the riser is in the path of direct gas and catalyst flow from the second section and defines a secondary product outlet at its downstream end. A secondary product separator communicates with the secondary product outlet for separating spent catalyst from the secondary product. A stripper section strips hydrocarbons from the spent catalyst to produce stripped catalyst. A regenerator removes coke from the stripped catalyst to provide the source of regenerated catalyst.

The blending of carbonized and regenerated catalyst can provide ancillary advantages to the process. Combining both regenerated and carbonized catalyst in the ultrashort contacting zone and the disengaging vessel increases the solids-to-feed ratio in the reaction zone. A greater solids ratio improves catalyst and feed contacting and since the carbonized catalyst still has activity, the catalyst-to-oil ratio is increased. Moreover, the larger quantity of catalyst more evenly and quickly distributes the heat to the feed. The term "carbonized catalyst" refers to regenerated catalyst that has had at least some contact with the feed to deposit coke on the catalyst. Carbonized catalyst is usually referred to as "spent catalyst". However, spent catalyst is often thought of as originating from an FCC stripper. Accordingly, the term "carbonized catalyst" has been used in this application since the source of the carbonized catalyst can be from the intermediate section of the reaction conduit and may or may not include stripping.

The presence of coke on the catalyst can also benefit the process by reducing undesirable catalytic cracking reactions. The undesirable bimolecular reactions occur at highly acidic sites on the catalyst that are present on the fully regenerated catalyst. These sites strongly attract the hydrocarbon and are rapidly deactivated by coke accumulation. As subsequent recirculation passes coked particles through multiple cycles of riser contact without regeneration, these non-selective sites remain covered with catalyst so that only the more selective cracking sites remain active on the catalyst. The circulation of more selective sites can improve the yield of more desirable products.

The blending of catalyst is particularly suited for short contact time reaction systems and can be particularly useful in this invention. Under short contact time conditions, the catalyst and feed are kept in contact for very short periods of time and then quickly separated such that the catalyst undergoes little deactivation. Therefore, this invention will facilitate the recirculation of carbonized catalyst to the reaction zone without regeneration. The more feed and contact times are reduced, less deactivation will occur on the catalyst particles. The recycle of carbonized catalyst back to the riser also provides a convenient place for the return the catalyst separated in the intermediate section.

Additional objects, embodiments, details, and alternate arrangements for this invention are described in the following detailed description of the invention.

BRIEF DESCRIPTION OF THE DRAWING

The FIGURE is a sectional elevation showing a riser and reactor arrangement for this invention.

The initial contacting of feed and catalyst with the subsequent withdrawal of the first product stream from an intermittent section of the riser can be used to effect long or short catalyst contact. The residence time will primarily depend on the relative location of the first separation section to the feed introduction point. It is preferred that this invention be used with a lift gas arrangement wherein steam or other inert gas initially transports catalyst up the riser before it contacts the feed to pre-accelerate the catalyst and establish a uniform catalyst flow before introduction of the feed.

This invention is more fully explained in the context of an FCC process. The FIGURE shows a typical schematic arrangement of an FCC unit arranged in accordance with this invention. The description of this invention in the context of the specific process arrangement shown is not meant to limit it to the details disclosed therein. The FCC arrangement shown in the FIGURE consists of a reactor vessel 10, a stripper 12, a regeneration section 14, and an elongated riser reaction zone 16 that provides a conversion zone for the pneumatic conveyance of catalyst. The arrangement circulates catalyst and contacts feed in the manner hereinafter described.

The catalyst used in this invention can include any of the well-known catalysts that are used in the art of fluidized catalytic cracking. These compositions include amorphous-clay type catalysts which have, for the most part, been replaced by high activity, crystalline alumina silica or zeolite containing catalysts. Zeolite-containing catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more. ZSM-5 type catalysts are particularly preferred since the high coke selectivity of these catalyst will tend to preserve active sites as coke containing catalyst makes multiple passes through the riser and thereby maintain overall activity.

In addition to catalyst, this invention may benefit from the circulation of inert particulate material. Recirculating solids on the reaction side of the process without regeneration will raise the level of coke on solids and can result in excessive regenerator temperature. Adding an inert material will decrease the average coke on solids ratio for material entering the regenerator without affecting the solids-to-oil ratio on the reactor side of the process. In this manner, the inert material acts as a heat sink in the regeneration process. Suitable inert solids are any refractory material with low coke production properties such as alpha alumina, fused alumina, and low surface area clays. Material and methods for recycling inert solids in an FCC process are further described in U.S. Pat. No. 4,859,313, the contents of which are hereby incorporated by reference.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650° to 1025° F. and is prepared by vacuum fractionation of atmospheric residue. These fractions are generally low in coke precursors and the heavy metals which can deactivate the catalyst. Heavy or residual feeds, i.e. boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects overcome. Metals, however, accumulate on the catalyst and poison the catalyst by fusing within the catalyst and permanently blocking reaction sites. In:addition, the metals promote undesirable cracking, thereby interfering with the reaction process. Thus, the presence of metals usually influences the regenerator operation, catalyst selectivity, catalyst activity, and the fresh catalyst makeup required to maintain constant activity.. The contaminant metals include nickel, iron, and vanadium. In general, these metals affect selectivity in the direction of less gasoline and more coke. Due to these deleterious effects, the use of metal management procedures within or before the reaction zone are anticipated in processing heavy feeds by this invention.

In a preferred arrangement for this invention, regenerated catalyst from catalyst regenerator 14 passes downwardly into a "Y" section located at the bottom of a first riser section 20 through a conduit 18. Appropriate control valve means (not shown) can control the flow of catalyst into conduit 18. Carbonized catalyst from a separator 24 enters the "Y" section through a conduit 22 and blends with the regenerated catalyst. Although not shown, carbonized catalyst in the form of spent catalyst from stripper 12 may also be recycled directly to the bottom of riser section 20 to provide additional quantities of catalyst and temperature control. A lift fluid enters the "Y" through a conduit 26 and transports the blended carbonized and regenerated catalyst up through the first section of the riser into contact with a feedstream. Feedstream nozzles 28 inject the feedstream into the flowing blend of regenerated and carbonized catalyst that continues to pass upwardly through the riser. The first section of the riser 20 defines the initial feed contacting and catalyst blending section of the riser. Volumetric expansion resulting from the rapid vaporization of the feed that enters the riser decreases the catalyst density within the riser to typically less than 5 lbs/ft$^3$. The duration of initial feed contacting accomplished in the first section of the riser can be in a range of from 0.2 to 5 seconds with a preferred contacting time being approximately 2 seconds or less.

The end of first riser section 20 is along a continuous flow path for passing catalyst and feed directly to a second section 30 of riser 16. A continuous flow path for the purposes of this invention means that the flow of catalyst and gases continues along the riser without any sharp change in direction and with only minor production of turbulence and backmixing. The continuous flow path need not be straight as depicted in the FIGURE but may pass the feed along a curvilinear or other relatively smooth flow path.

The second riser section 30 provides separation of the initial feed which has preferably undergone short contacting. The separation section of the riser may use any type of separator arrangement that does not unduly disrupt the flow of catalyst and gases that continue up the riser. Whatever separation section is used, it will reduce the catalyst concentration in the withdrawn stream until it is a principally gas phase stream. The term "principally gas phase stream" means for this invention a stream having a catalyst loading of less than 1 lb/ft$^3$.

A ballistic separation section is particularly preferred for this purpose. A baffle 32 provides a traditional ballistic separation in an intermediate portion of the riser. The central portion of baffle 32 provides an open flow channel that minimizes the disruption of the direct flow of most catalyst and gases along the riser. To its outside, the baffle creates a vapor collection chamber 34 with an open annular inlet at its upper end and a lower end closed by the bottom of baffle 32. Gases flow from chamber 34 through a short contact product outlet or cyclone inlet 36. The flow out of cyclone inlet 36 is controlled so that about 60–90% of the vapors passing through section 20 of the riser are collected in annular space 34. The flow out of conduit 36 is preferably controlled downstream of separator 24 so that any control valve is exposed to the minimum amount of catalyst. Ballistics separation of this type is expected to reduce catalyst loadings in the product stream to less than 0.4 lb/ft$^3$.

Cyclone 24 removes substantially all residual catalyst that remains in the product stream after its initial withdrawal from riser section 30. Separated product vapors from cyclone 24 pass overhead through a conduit 38. Carbonized catalyst collected by cyclone 24 returns to the riser via the conduit 22 as previously described. The return of the carbonized catalyst to the riser has the advantages as previously discussed. Recycle of the carbonized catalyst from the first stage of contacting in the riser is particularly advantageous since it will contain a minimum equilibrium balance of coke.

The remaining hydrocarbons and catalyst that pass upwardly from baffle 32 enter a riser section 40 that extends from riser section 30 to the end 42 of riser 16. Further contacting of catalyst with the hydrocarbons that are entrained or adsorbed on the catalyst take place through riser section 40. Nozzles 44 may be used to inject a secondary feed into section 40 of the riser. In this manner, section 40 can operate as a secondary cracking zone for production of secondary products from the secondary feed that enters section 40.

Riser section 40 delivers the remainder of the catalyst and hydrocarbons into a high containment separation device shown generally by reference numeral 46. The high containment section imparts a tangential velocity to the gas and catalyst mixture as it leaves the end of the riser to rapidly separate catalyst and vapors in a low volume chamber that limits the residence of the vapors. The depicted arrangement has riser section 40 passing up through reactor vessel 10 as a central conduit. End 42 of the riser delivers a mixture of catalyst particles and gases to a pair of arms 47 that tangentially discharge the mixture of catalyst particles and gases into a separation vessel 48 through discharge openings 49. The tangential delivery of the mixture of catalyst particles and gases effects separation of the gases from the catalyst with the catalyst particles passing downwardly through the separation vessel 48 and out of a lower portion of the separation vessel through an outlet 51.

Gas recovery conduit 52 withdraws gases comprising secondary product hydrocarbons and stripping medium from the separation vessel at a location below discharge opening 49 through an annular inlet 54 defined by an enlarged shroud 56 that shrouds the end 42 of the riser. Holes provided in the sides of shroud 56 provide slots through which arms 47 pass. The structure of shroud 56 and arms 47 again provide a preferred structure wherein the gases and catalyst are discharged at a radial distance from the center of riser section 40 that is greater than the distance from inlet opening 54 to the riser. These relative locations place gases containing a lower concentration of catalyst closer to the center of the separation device 46 and riser section 40 for removal through annular inlet 54.

Reactor vessel 60 serves as a containment vessel that houses the separation vessel 48. Additional stripping takes place below separation vessel 48 and stripping fluid passes into and upwardly across the surface of a bed 58. Reactor vessel 60 also confines gases passing across the surface of bed 58. Gases in the upper volume of reactor vessel 10 enter the gas recovery conduit 52 through a series of ports 62. The combined stream of separated gases from inlet 54 and additional stripping fluid and gases from port 62 pass upwardly through recovery conduit 52 and into a traditional cyclone separator 64 that again effects a further separation of the remaining catalyst that is still entrained with the gases. Gases exit the top of cyclone 64 through an outlet 66 while recovered catalyst particles pass downwardly through a dipleg conduit 68 at a rate regulated by a flapper valve 70. Catalyst from dipleg conduit 68 and bed 58 passes out of the reactor vessel for downward transport into stripper 12 through opening 57. Further details of a separation device as depicted by numeral 46 can be found in U.S. Pat. No. 5,565,020, the contents of which are hereby incorporated by reference. Other useful swirl arm arrangements are more fully described in U.S. Pat. No. 4,397,738, the contents of which are hereby incorporated by reference.

Prior to passing through outlet 51, catalyst collects in bed 53 contained within the separation vessel 48. An initial displacement of gases comprising product hydrocarbons may be effected in bed 53 by contact with a stripping fluid. In this arrangement, stripping fluid is delivered to the underside of a baffle 55 and passes through a series of holes in baffle 55 (not shown). Catalyst from catalyst beds 58 and 53 passes downwardly through a stripping vessel 12 where countercurrent contact with a stripping fluid through a series of stripping baffles 59 displaces product gases from the catalyst as it continues downwardly through the stripping vessel 12.

Stripped catalyst from stripping vessel 12 passes through a conduit 61 to catalyst regenerator 14 that rejuvenates the catalyst by contact with an oxygen-containing gas. High temperature contact of the oxygen-containing gas with the catalyst oxidizes coke deposits from the surface of the catalyst. Following regeneration, catalyst particles enter the bottom of reactor riser 16 through conduit 18 as previously described.

As previously stated, a portion of the stripped catalyst may be blended with the regenerated catalyst in riser 16. Blending the stripped and regenerated catalyst in this manner further increases the relative amount of catalyst that contacts the feed. The amount of blended catalyst that contacts the feed will vary depending on the temperature of the regenerated catalyst and the ratio of recycled to regenerated catalyst comprising the catalyst blend. Where employed, the ratio of blended catalyst to feed, including any carbonized catalyst from the first stage of riser separation, will be in a ratio of from 5 to 50. Preferably, the blended catalyst to feed will be in a ratio of from 10 to 20 and more preferably in ratio of from 10 to 15.

Primary and secondary products recovered from conduit 68 are typically transferred to a separation zone for the removal of light gases and heavy hydrocarbons from the products. Product vapors enter a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities.

What is claimed is:

1. An apparatus for the fluidized catalytic cracking of hydrocarbons, said apparatus comprising:

a continuous transport contacting conduit for passing a mixture of gas and catalyst therethrough having a first section defining a catalyst inlet in communication with a source of regenerated catalyst proximate its upstream end, means for injecting a feedstream into said first section, a second section in the path of direct gas and catalyst flow from said first section defining a short contact product outlet for recovering a short contact product stream, and a third section in the path of direct gas and catalyst flow defining a secondary product outlet at its downstream end;

a secondary product separator in communication with said secondary product outlet for separating spent catalyst from a secondary product;

a stripper for stripping hydrocarbons from said spent catalyst to produce stripped catalyst; and a regenerator for removing coke from said stripped catalyst that provides said source of regenerated catalyst.

2. The apparatus of claim 1 wherein said second section contains a baffle defining an annular chamber for ballistic separation of gas from catalyst and said short contact product outlet communicates directly with said annular chamber.

3. The apparatus of claim 1 wherein means are provided for injecting a secondary feed into said third section.

4. The apparatus of claim 1 wherein an external separator communicates with said short contact product outlet to recover carbonized catalyst from the short contact product stream and a conduit transfers carbonized catalyst from said external separator to the first section.

5. The apparatus of claim 1 wherein the length of the first section between said means for injecting a feedstream and said second section is less than the length of said third section.

6. The apparatus of claim 1 wherein said transport contacting conduit comprises a generally vertical riser, said catalyst inlet is located upstream of said means for injecting a feedstream, and the first section contains a fluidizing inlet gas nozzle upstream of said means for injecting a feedstream for injecting a fluidizing gas into said first section.

7. An apparatus for the fluidized catalytic cracking of hydrocarbons, said apparatus comprising:

a continuous transport contacting conduit for passing a mixture of gas and catalyst therethrough having a first section defining a catalyst inlet in communication with a source of regenerated catalyst proximate its upstream end, means for injecting a feedstream into said first section, a second section in the path of direct gas and catalyst flow from said first section defining a short contact product outlet for recovering a short contact product stream, and a third section in the path of direct gas and catalyst flow defining a secondary product outlet at its downstream end, and nozzles for injecting a secondary feed into said third section;

a secondary product separator in communication with said secondary product outlet for separating spent catalyst from a secondary product;

a stripper for stripping hydrocarbons from said spent catalyst to produce stripped catalyst; and a regenerator for removing coke from said stripped catalyst that provides said source of regenerated catalyst.

8. An apparatus for the fluidized catalytic cracking of hydrocarbons, said apparatus comprising:

a continuous transport contacting conduit for passing a mixture of gas and catalyst therethrough having a first section defining a catalyst inlet in communication with a source of regenerated catalyst proximate its upstream end, means for injecting a feedstream into said first section, a second section in the path of direct gas and catalyst flow from said first section defining a short contact product outlet for recovering a short contact product stream, and a third section in the path of direct gas and catalyst flow defining a secondary product outlet at its downstream end;

a secondary product separator in communication with said secondary product outlet for separating spent catalyst from a secondary product and a conduit for transferring spent catalyst from said secondary product separator to the first section;

a stripper for stripping hydrocarbons from said spent catalyst to produce stripped catalyst; and a regenerator for removing coke from said stripped catalyst that provides said source of regenerated catalyst.

* * * * *